US008831259B2

(12) United States Patent
Koo et al.

(10) Patent No.: US 8,831,259 B2
(45) Date of Patent: Sep. 9, 2014

(54) HEARING AID FACEPLATE ARRANGEMENT

(75) Inventors: Wee Haw Koo, Singapore (SG); Beng Hai Tan, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 143 days.

(21) Appl. No.: 13/119,778

(22) PCT Filed: Sep. 18, 2008

(86) PCT No.: PCT/SG2008/000353
§ 371 (c)(1),
(2), (4) Date: Mar. 18, 2011

(87) PCT Pub. No.: WO2010/033077
PCT Pub. Date: Mar. 25, 2010

(65) Prior Publication Data
US 2011/0164773 A1 Jul. 7, 2011

(51) Int. Cl.
*H04R 25/00* (2006.01)

(52) U.S. Cl.
USPC ..... 381/322; 381/324

(58) Field of Classification Search
CPC .... H04R 25/65; H04R 25/652; H04R 25/658; H04R 25/60; H04R 25/604
USPC ..... 312/334.1; 108/143; 381/322, 324
See application file for complete search history.

(56) References Cited

U.S. PATENT DOCUMENTS 2,937,765 A * 5/1960 Shank ..... 108/143
3,865,998 A * 2/1975 Weiss et al. ..... 381/324
4,418,787 A 12/1983 Eggert et al.
5,001,762 A 3/1991 Barwig et al.
5,008,943 A 4/1991 Arndt et al.
5,201,008 A 4/1993 Arndt et al.
5,204,917 A * 4/1993 Arndt et al. ..... 381/324
5,586,188 A 12/1996 Renggli et al.
5,681,116 A * 10/1997 Lin ..... 384/42
5,790,672 A * 8/1998 Klostermeier ..... 381/328
6,389,143 B1 5/2002 Leedom et al.
6,430,296 B1 * 8/2002 Olsen ..... 381/322
6,456,720 B1 * 9/2002 Brimhall et al. ..... 381/324
6,678,385 B2 * 1/2004 Olsen ..... 381/322
6,825,788 B2 11/2004 Wouters
6,843,690 B2 * 1/2005 Sauer et al. ..... 439/722
(Continued)

FOREIGN PATENT DOCUMENTS

CH 660531 A5 4/1987
DE 3428166 A1 2/1986
(Continued)

*Primary Examiner* — Duc Nguyen
*Assistant Examiner* — Sean H Nguyen
(74) *Attorney, Agent, or Firm* — Laurence A. Greenberg; Werner H. Stemer; Ralph E. Locher

(57) ABSTRACT

In an embodiment, a hearing aid faceplate arrangement (102) is provided. The hearing aid faceplate arrangement (102) may include a hearing aid housing and a faceplate arrangement (110) positioned on the hearing aid housing. The faceplate arrangement (110) may include a faceplate (108), the faceplate (108) including a receiving portion (112) and a faceplate module (106), the faceplate module (106) including a faceplate module housing (114) having an electronic circuit (116). The faceplate module (106) is configured to be fitted into the receiving portion (112).

30 Claims, 6 Drawing Sheets

(56) References Cited

U.S. PATENT DOCUMENTS

| | | | | |
|---|---|---|---|---|
| 6,879,697 | B2 * | 4/2005 | Tøpholm | 381/322 |
| 7,006,647 | B1 | 2/2006 | Wuersch | |
| 7,016,512 | B1 | 3/2006 | Feeley et al. | |
| 7,024,012 | B2 * | 4/2006 | Olsen | 381/322 |
| 7,113,611 | B2 | 9/2006 | Leedom et al. | |
| 7,130,437 | B2 * | 10/2006 | Stonikas et al. | 381/322 |
| 7,142,926 | B2 | 11/2006 | Crawford | |
| 7,151,839 | B2 | 12/2006 | Niederdränk | |
| 7,191,029 | B2 * | 3/2007 | Marxen et al. | 700/118 |
| 7,394,911 | B2 | 7/2008 | Joergensen et al. | |
| 7,403,629 | B1 | 7/2008 | Aceti et al. | |
| 7,551,894 | B2 | 6/2009 | Gerber et al. | |
| 8,068,631 | B2 * | 11/2011 | Saltykov et al. | 381/328 |
| 2001/0036288 | A1 | 11/2001 | Robinson et al. | |
| 2004/0120538 | A1 | 6/2004 | Hall et al. | |
| 2005/0232453 | A1 * | 10/2005 | Fideler | 381/322 |
| 2006/0104466 | A1 * | 5/2006 | Olsen | 381/323 |
| 2007/0113928 | A1 * | 5/2007 | Liu et al. | 144/286.5 |
| 2007/0177750 | A1 * | 8/2007 | Nielsen | 381/324 |
| 2007/0269070 | A1 * | 11/2007 | Kasanmascheff et al. | 381/324 |
| 2007/0286442 | A1 * | 12/2007 | Hessel et al. | 381/322 |
| 2007/0293972 | A1 * | 12/2007 | Roth et al. | 700/118 |
| 2008/0304685 | A1 * | 12/2008 | Fideler | 381/323 |
| 2009/0060241 | A1 * | 3/2009 | Saltykov et al. | 381/324 |
| 2010/0260368 | A1 * | 10/2010 | Heerlein et al. | 381/323 |
| 2013/0108089 | A1 * | 5/2013 | Lin | 381/313 |

FOREIGN PATENT DOCUMENTS

| | | | |
|---|---|---|---|
| DE | 19603806 | A1 | 8/1997 |
| EP | 0288822 | A1 | 11/1988 |
| EP | 0521329 | A1 | 1/1993 |
| EP | 0 682 461 | A2 | 11/1995 |
| FR | 2634646 | A1 | 2/1990 |
| WO | 0069216 | A2 | 11/2000 |
| WO | WO01/43497 | A1 | 6/2001 |

* cited by examiner

HEARING AID FACEPLATE ARRANGEMENT

BACKGROUND OF THE INVENTION

Field of the Invention

Embodiments relate to a hearing aid faceplate arrangement.

A hearing aid is usually fitted in or behind the ear of an user to amplify the sound for the user. Some popular types of hearing aids include behind-the-ear (BTE) aids, in the ear (ITE) aids, in the canal (ITC) aids, completely in the canal (CIC) aids, etc.

The hearing aid usually includes a hearing aid housing and a faceplate attached to the hearing aid housing, thereby forming an enclosed space. A microphone for collecting sound waves is generally located at a fixed position on the faceplate.

As a single faceplate is usually not configured to be used for different microphone types and for both sides of the ear of the hearing aid user, different faceplates have to be used depending on user requirements.

BRIEF SUMMARY OF THE INVENTION

In various embodiments, a hearing aid faceplate arrangement is provided, which improves flexibility in production so that changes in microphone types can be implemented easily and without incurring significant costs. Further, the hearing aid faceplate arrangement according to various embodiments may also enable a hearing aid user to use the same faceplate for different sides of the ear. In addition, the hearing aid faceplate arrangement in accordance with various embodiments may allow flexibility in fitting of the hearing aid on the hearing aid user since the hearing aid faceplate arrangement may allow an adjustment of the position of the microphone to fit the specific ear canal shape.

An embodiment relates to a hearing aid faceplate arrangement. The hearing aid faceplate arrangement may include a hearing aid housing and a faceplate arrangement positioned on the hearing aid housing. The faceplate arrangement may include a faceplate, the faceplate including a receiving portion; and a faceplate module, the faceplate module including a faceplate module housing having an electronic circuit. The faceplate module may be configured to be fitted into the receiving portion. The faceplate module housing may be formed by an insert molding process.

In an embodiment, the receiving portion may include a first engaging portion.

In an embodiment, the first engaging portion may include at least one recess or at least one protrusion. The first engaging portion may be of any suitable shape or of any suitable dimensions depending on design requirements.

In an embodiment, the receiving portion may further include a first opening for receiving a battery. The first opening may be rectangle in shape or may be of any suitable shape depending on design requirements, e.g. circular or elliptic. The first opening may also be of any suitable dimensions depending on design requirements.

In an embodiment, the receiving portion may further include a second opening or through hole, the second opening positioned adjacent to the first opening. The receiving portion may further include two second openings, or any suitable number of second openings depending on the number of microphones. The second opening may be round in shape and may be of any suitable shape depending on design requirements. The second opening may also be of any suitable dimensions depending on design requirements. Each of the second openings may allow for receiving an acoustic input signal and converts it into an electrical signal.

In an embodiment, the faceplate module housing may include a second engaging portion, the second engaging portion configured to engage with the first engaging portion. The faceplate module housing may include two second engaging portions, each of the two second engaging portions may extend from opposite sides of the faceplate module housing.

In an embodiment, the second engaging portion may be complementary to the first engaging portion. The second engaging portion may be of a complementary shape to the first engaging portion. By way of example, if the first engaging portion may include a recess, the second engaging portion may include a protrusion. If the first engaging portion may include a protrusion, the second engaging portion may include a recess. The number of second engaging portion may be the same as the number of first engaging portion.

In an embodiment, the second engaging portion may include at least one protrusion or at least one recess. The second engaging portion may be of any suitable shape or of any suitable dimensions depending on design requirements.

In an embodiment, the faceplate module housing may further include at least one programming contact. The programming contact may be made of a conductive material, for example Beryllium Copper Alloy with Gold Plating. The programming contact may be used for subsequent contact or connection to a programmer for example a computer, via a flexible cable.

In an embodiment, the faceplate module housing may further include a pair of battery contacts. The battery contact may be in contact with the battery used to power the hearing aid. Each of the battery contacts may be made of a conductive material, for example stainless steel with gold plating.

In an embodiment, the faceplate module housing may further include a third opening positioned between the pair of battery contacts for receiving the battery. The third opening may allow for the accommodation of the battery to be in subsequent contact with the battery contacts. The third opening may be rectangle in shape or may be of any suitable shape or of any suitable dimensions depending on design requirements.

In an embodiment, the third opening may be configured to align with the first opening when the faceplate module may be fitted into the receiving portion.

In an embodiment, the electronic circuit may be selected from a group consisting of an amplifier or a so-called hybrid, a surface mount device, a plurality of solder contacts, and a receiver. The electronic circuit may be adhered to the faceplate module housing via an adhesive or glue.

In an embodiment, the faceplate module housing may further include a third engaging portion or a so-called locating feature.

In an embodiment, the third engaging portion may be positioned on at least one side of the faceplate module housing. By way of example, the third engaging portion may surround all sides of the faceplate module housing depending on design requirements.

In an embodiment, the third engaging portion may include a recess. The third engaging portion may be of any suitable shape or of any suitable dimensions depending on design requirements.

In an embodiment, the faceplate module may further include a microphone housing for accommodating at least one microphone. The microphone housing may be positioned on any one of the four sides of the faceplate module housing depending on user requirements. The microphone housing may be a separate component from the faceplate module housing and may be detachable from the faceplate module housing.

In an embodiment, the microphone may be an omnidirectional microphone, which may be configured to record in all directions. Embodiments may provide for directional information even when using an omnidirectional microphone in an easy and relatively inexpensive manner. The microphone may also be a directional microphone or a voice microphone, but not so limited.

In an embodiment, the microphone housing may be configured to movably engage with the faceplate module housing.

In an embodiment, the microphone housing may include a fourth engaging portion, the fourth engaging portion configured to engage the third engaging portion.

In an embodiment, the fourth engaging portion may be positioned on or extend from at least one side of the microphone housing.

In an embodiment, the fourth engaging portion may be complementary to the third engaging portion. The fourth engaging portion may be of a complementary shape to the third engaging portion. By way of example, if the third engaging portion may include a recess, the fourth engaging portion may include a protrusion. If the third engaging portion may include a protrusion, the fourth engaging portion may include a recess.

In an embodiment, the fourth engaging portion may include a protrusion. The protrusion may be of any suitable dimensions depending on design requirements.

In an embodiment, the fourth engaging portion may include a single wedge shape structure or a plurality of wedge shape structures. The fourth engaging portion may be of any suitable shape depending on design requirements.

In an embodiment, the microphone housing may include a groove or a recess for accommodating the at least one microphone. The microphone housing may include more than one groove or recess and the number of groove may correspond to the number of microphone. The number of microphone may depend on design and user requirements.

In an embodiment, the microphone housing may further include a fourth opening or through hole positioned within the groove. The microphone housing may further include two fourth openings, or any suitable number of fourth openings depending on the number of microphones. Each of the fourth openings may be round in shape and may be of any suitable shape depending on design requirements. The fourth opening may also be of any suitable dimensions depending on design requirements. The fourth opening may be positioned at any suitable position within the groove.

In an embodiment, the fourth opening may be configured to align with the second opening when the faceplate module may be fitted into the receiving portion.

In an embodiment, the faceplate module may be detachable from the faceplate. The faceplate module may be a separate component from the faceplate to enable reusability and to facilitate ease of manufacturing.

In an embodiment, the faceplate may include a material selected from the group consisting of a plastic material, a resin material for example a cellidor resin material. The faceplate may include any other suitable material.

In an embodiment, the faceplate module may include a material selected from the group consisting of a plastic material, a resin material for example a cellidor resin material. The faceplate module may include any other suitable material.

In an embodiment, the faceplate module may be of the same material as the faceplate. The faceplate module may be fabricated with a similar process as the faceplate.

In an embodiment, the faceplate module housing may be of the same material as the microphone housing. The faceplate module housing may be fabricated with a similar process as the microphone housing. The faceplate module housing may include a material selected from the group consisting of a plastic material, a resin material. The microphone housing may include a material selected from the group consisting of a plastic material, a resin material. The faceplate module housing and the microphone housing may include any other suitable material.

In an embodiment, the first opening on the faceplate for receiving the battery may be covered by the battery cover, thereby the first opening may not be visible from the outside.

In an embodiment, the faceplate may be a flat surface or a surface with a certain degree of curvature depending on design requirements.

In an embodiment, the faceplate module may be of any suitable color. The faceplate module may not be visible from the outside as the faceplate module may be covered by the battery cover.

An embodiment relates to a faceplate arrangement. The faceplate arrangement may include a faceplate, the faceplate including a receiving portion; and a faceplate module, the faceplate module including a faceplate module housing having an electronic circuit. The faceplate module may be configured to be fitted into the receiving portion.

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which:

DESCRIPTION OF THE INVENTION

Figure 1A:
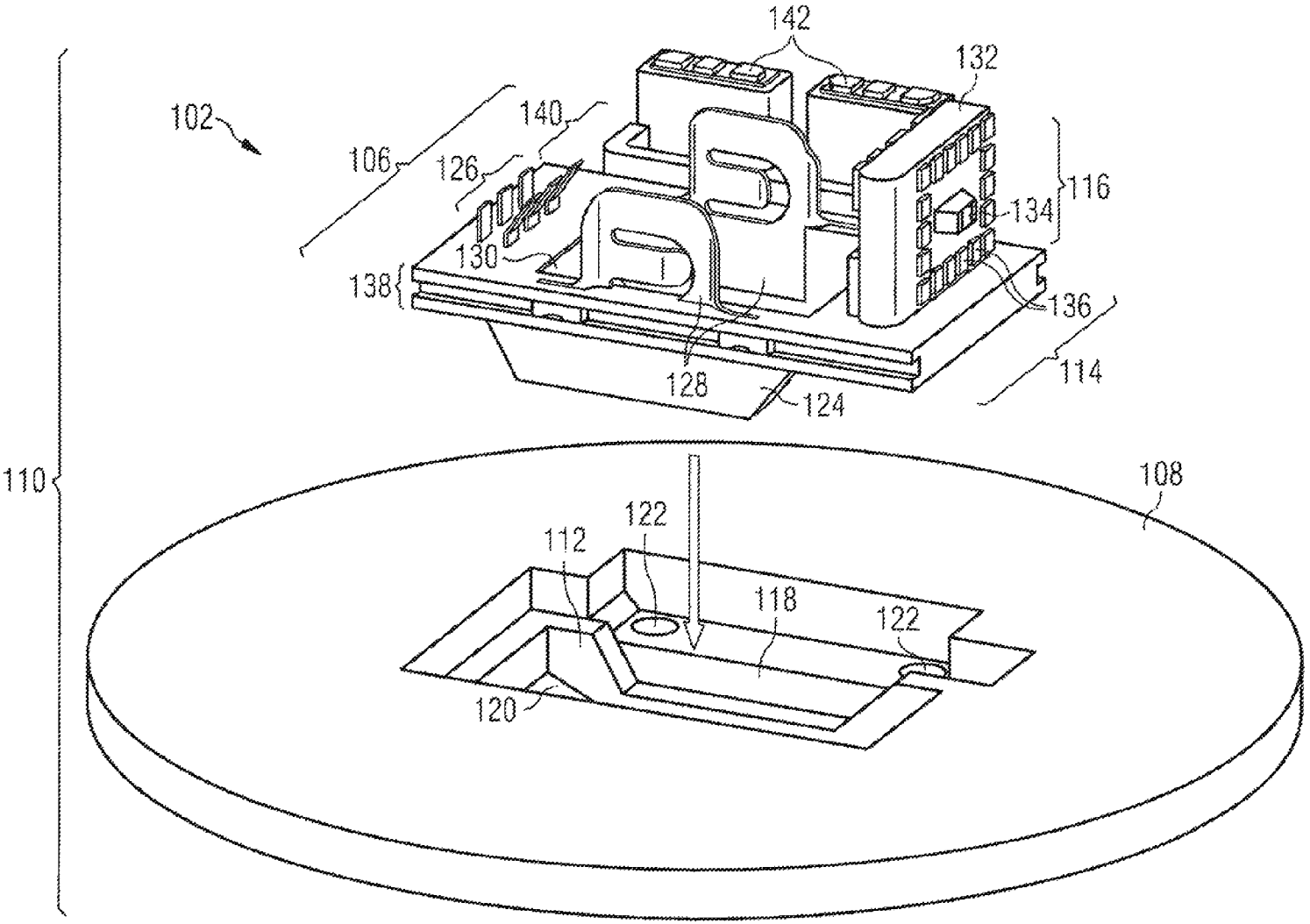
FIG. 1A shows a hearing aid faceplate arrangement (hearing aid housing not shown and the faceplate module detached from the faceplate) and FIG. 1B shows a hearing aid faceplate arrangement (hearing aid housing not shown and the faceplate module fitted into the faceplate) according to an embodiment.
Figure 1B:
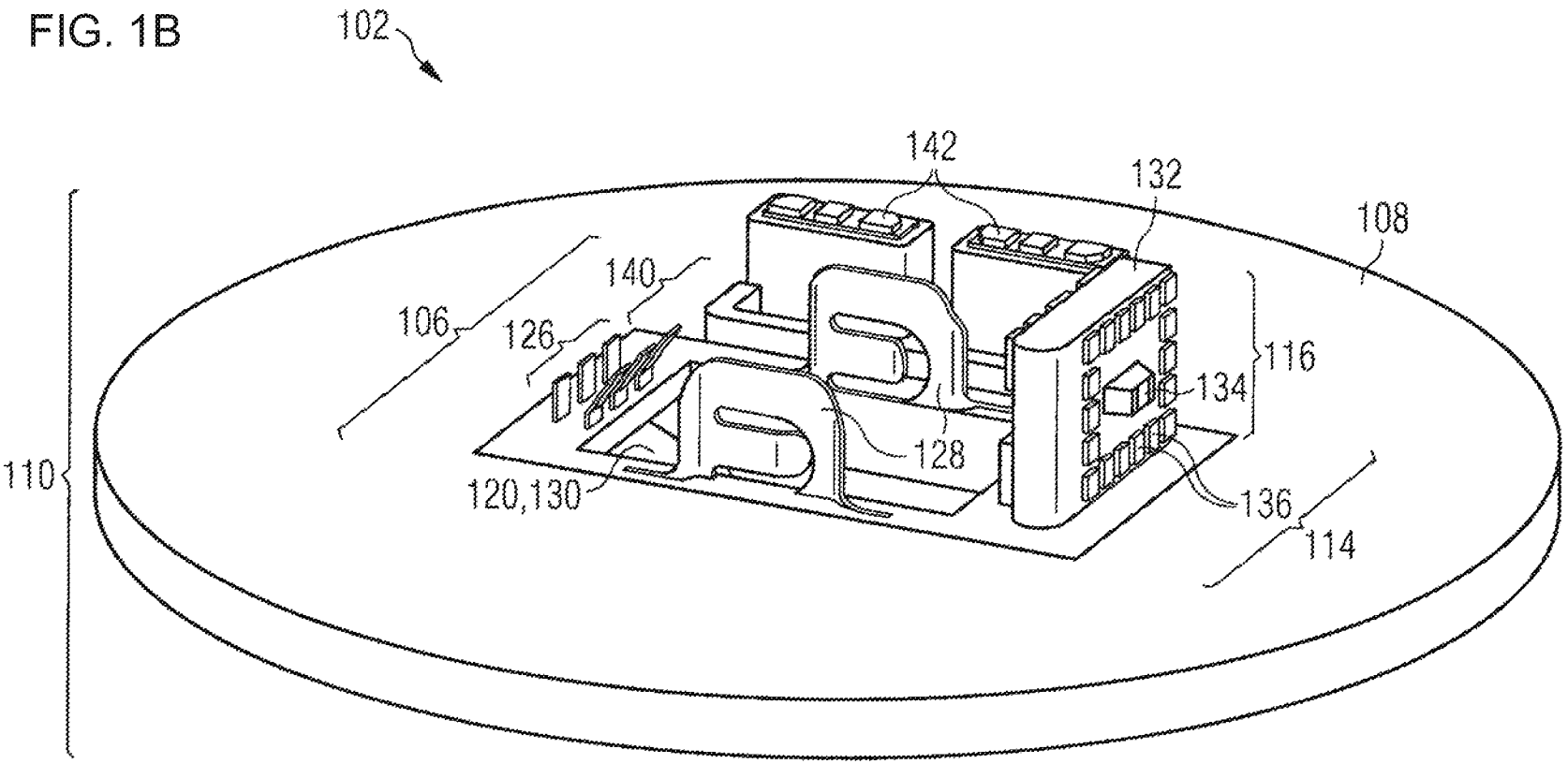

FIG. 1A shows a hearing aid faceplate arrangement 102 (hearing aid housing not shown and the faceplate module 106 detached from the faceplate 108) and FIG. 1B shows a hearing aid faceplate arrangement 102 (hearing aid housing not shown and the faceplate module 106 fitted into the faceplate 108) according to an embodiment.

In FIG. 1A and in FIG. 1B, the hearing aid faceplate arrangement 102 may include a hearing aid housing (not shown) and a faceplate arrangement 110 positioned on the hearing aid housing. The faceplate arrangement 110 may include a faceplate 108, the faceplate 108 including a receiving portion 112 and a faceplate module 106, the faceplate module 106 including a faceplate module housing 114 having an electronic circuit 116. The faceplate module 106 may be configured to be fitted into the receiving portion 112.

The receiving portion 112 may include a first engaging portion 118 and the first engaging portion 118 may include two recesses (only one recess is shown in FIG. 1A). The receiving portion 112 may further include a first opening 120 for receiving a battery (not shown). The receiving portion 112 may further include two second openings 122, the two second openings 122 positioned adjacent to the first opening 120. Each of the two second openings 122 may be positioned spaced apart from each other.

The faceplate module housing 114 may include a second engaging portion 124, the second engaging portion 124 may be configured to engage with the first engaging portion 118. The second engaging portion 124 may be complementary to the first engaging portion 118. The second engaging portion 124 may include two protrusions (only one protrusion is shown in FIG. 1A). Each of the two protrusions 124 may extend from opposite sides of the faceplate module housing 114. The faceplate module housing 114 may further include at least one programming contact 126 and a pair of battery contacts 128. The pair of battery contacts 128 may be positioned between the at least one programming contact 126 and the electronic circuit 116. The faceplate module housing 114 may further include a third opening 130 positioned between the pair of battery contacts 128 for receiving the battery. The third opening 130 may be configured to align with the first opening 120 when the faceplate module 106 may be fitted into the receiving portion 112. The electronic circuit 116 may include an amplifier 132, a surface mount device 134 and a plurality of solder contacts 136. The faceplate module housing 114 may further include a third engaging portion 138. The third engaging portion 138 may surround all sides of the faceplate module housing 114. The third engaging portion 138 may include a recess.

The faceplate module 106 may further include a microphone housing 140 for accommodating one or more microphones 142, e.g. two microphones 142. The microphone housing 140 may be configured to movably engage with the faceplate module housing 114.

The microphone housing 140 may include a fourth engaging portion (not shown), the fourth engaging portion configured to engage the third engaging portion 138. The fourth engaging portion may be positioned on at least one side of the microphone housing 140. The fourth engaging portion may be complementary to the third engaging portion 138. The fourth engaging portion may include a protrusion. The fourth engaging portion may include a single wedge shape structure or a plurality of wedge shape structures.

The microphone housing 140 may include two grooves (not shown) for accommodating the two microphones 142. The microphone housing 140 may further include a fourth opening (not shown) positioned within each of the two grooves. Each of the fourth openings may be configured to align with each of the second openings 122 when the faceplate module 106 may be fitted into the receiving portion 112.

The faceplate module 106 may be detachable from the faceplate 108. The faceplate module 106 may engages and disengages with the faceplate 108 via the second engaging portion 124 on the faceplate module 106 and the first engaging portion 118 on the faceplate 108.

The faceplate 108 may include a material selected from the group consisting of a plastic material, a resin material. The faceplate module 106 may include a material selected from the group consisting of a plastic material, a resin material. The faceplate module 106 may be of the same material as the faceplate 108. The faceplate module housing 114 may be of the same material as the microphone housing 140.

Figure 2A:
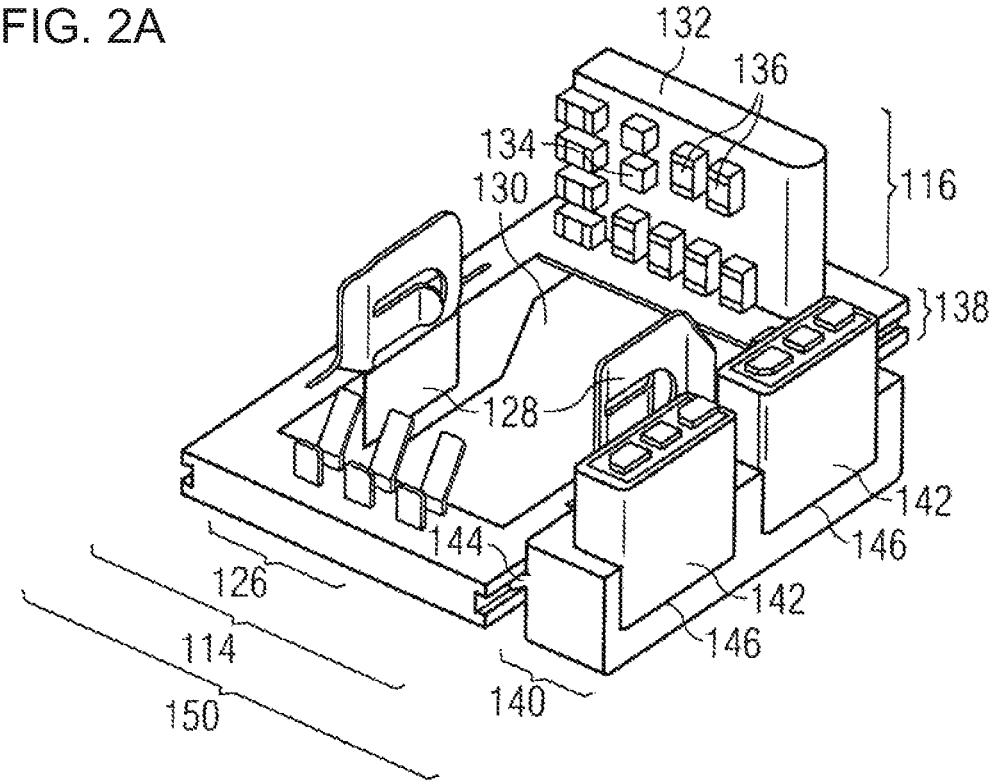
FIGS. 2A and 2B show a respective left faceplate module and a right faceplate module 152 for left and right ears according to an embodiment.
Figure 2B:
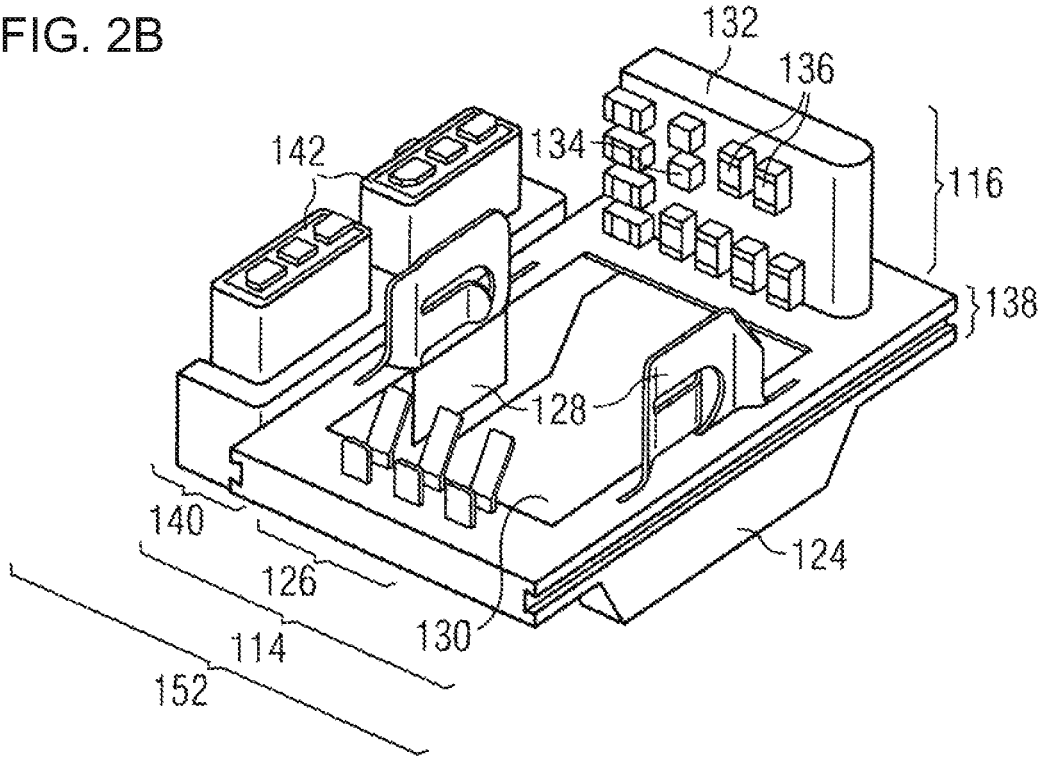

FIG. 2A and FIG. 2B show a respective left faceplate module 150 and a right faceplate module 152 for left and right ears according to an embodiment.

The faceplate module housing 114 may include a second engaging portion 124, the second engaging portion 124 may be configured to engage with the first engaging portion (not shown) on the faceplate (not shown). The second engaging portion 124 may be complementary to the first engaging portion. The second engaging portion 124 may include two protrusions (only one protrusion is shown in FIG. 2B). The faceplate module housing 114 may further include at least one programming contact 126 and a pair of battery contacts 128. The pair of battery contacts 128 may be positioned between the at least one programming contact 126 and the electronic circuit 116. The faceplate module housing 114 may further include a third opening 130 positioned between the pair of battery contacts 128 for receiving the battery. The third opening 130 may be configured to align with the first opening (not shown) when each of the left faceplate module 150 or the right faceplate module 152 may be fitted into the receiving portion of the faceplate. The electronic circuit 116 may include an amplifier 132, a surface mount device 134 and a plurality of solder contacts 136. The faceplate module housing 114 may further include a third engaging portion 138. The third engaging portion 138 may surround all sides of the faceplate module housing 114. The third engaging portion 138 may include a recess.

Each of the left faceplate module 150 or the right faceplate module 152 may further include a microphone housing 140 for accommodating two microphones 142. The microphone housing 140 may be configured to movably engage with the faceplate module housing 114.

The microphone housing 140 may include a fourth engaging portion 144, the fourth engaging portion 144 configured to engage the third engaging portion 138. The fourth engaging portion 144 may be positioned on at least one side of the microphone housing 140. The fourth engaging portion 144 may be complementary to the third engaging portion 138. The fourth engaging portion 144 may include a protrusion. The fourth engaging portion 144 may include a single wedge shape structure or a plurality of wedge shape structures.

The microphone housing 140 may include two grooves 146 for accommodating the two microphones 142. The microphone housing 140 may further include a fourth opening (not shown) positioned within each of the two grooves 146. Each of the fourth openings may be configured to align with each of the second openings when each of the left faceplate module 150 or the right faceplate module 152 may be fitted into the receiving portion.

Each of the left faceplate module 150 or the right faceplate module 152 may be detachable from the faceplate.

Each of the left faceplate module 150 or the right faceplate module 152 may include a material selected from the group consisting of a plastic material, a resin material. Each of the left faceplate module 150 or the right faceplate module 152 may be of the same material as the faceplate. The faceplate module housing 114 may be of the same material as the microphone housing 140.

For the left faceplate module 150, the microphone housing 140 may be positioned to the left of the electronic circuit 116, in contact with the faceplate module housing 114 as shown in FIG. 2A.

For the right faceplate module 152, the microphone housing 140 may be positioned to the right of the electronic circuit 116, in contact with the faceplate module housing 114 as shown in FIG. 2B.

Figure 3A:
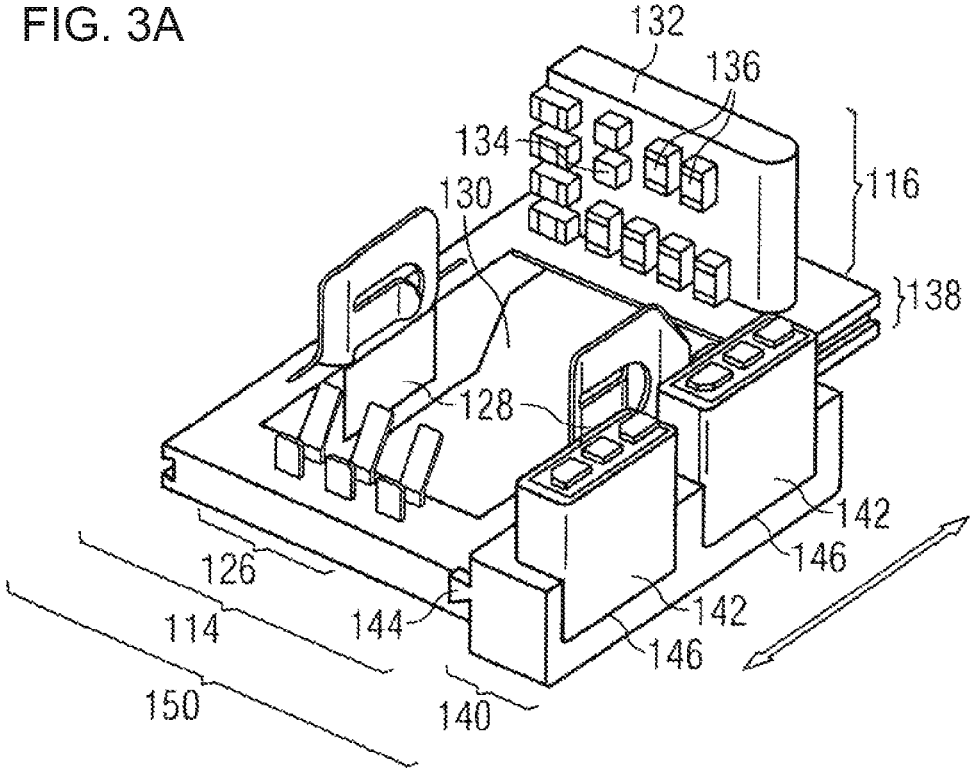
FIGS. 3A and 3B show a left faceplate module for left ear with an adjustable microphone housing at two different positions along a side of the faceplate module housing according to an embodiment.
Figure 3B:
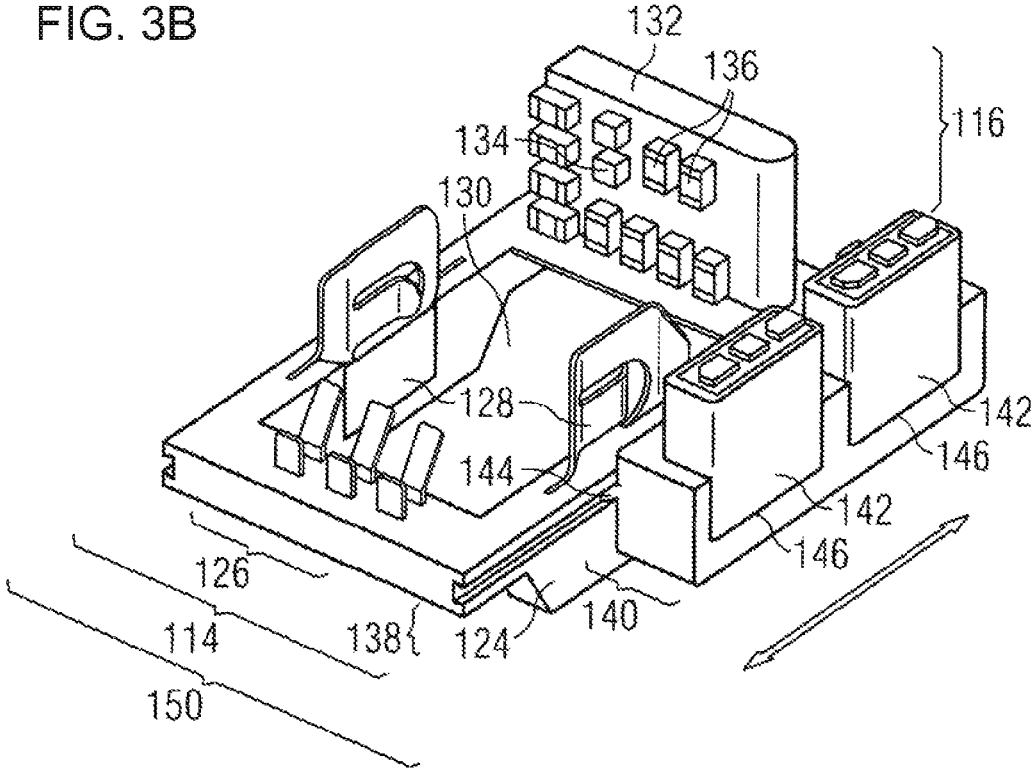

FIG. 3A and FIG. 3B show a left faceplate module 150 for left ear with an adjustable microphone housing 140 at two different positions along a side of the faceplate module housing 114 according to an embodiment.

The left faceplate module 150 where the microphone housing 140 may be at two different positions along the side of faceplate module housing 114 as shown in FIG. 3A and FIG. 3B may be the same as that shown in FIG. 2A and the corresponding description applies.

The faceplate module housing 114 may include a second engaging portion 124, the second engaging portion 124 may be configured to engage with the first engaging portion (not shown) on the faceplate (not shown). The second engaging portion 124 may be complementary to the first engaging portion. The second engaging portion 124 may include two protrusions (only one protrusion is shown in FIG. 3B). The faceplate module housing 114 may further include at least one programming contact 126 and a pair of battery contacts 128. The pair of battery contacts 128 may be positioned between the at least one programming contact 126 and the electronic circuit 116. The faceplate module housing 114 may further include a third opening 130 positioned between the pair of battery contacts 128 for receiving the battery. The third opening 130 may be configured to align with the first opening when the left faceplate module 150 may be fitted into the receiving portion. The electronic circuit 116 may include an amplifier 132, a surface mount device 134 and a plurality of solder contacts 136. The faceplate module housing 114 may further include a third engaging portion 138. The third engaging portion 138 may surround all sides of the faceplate module housing 114. The third engaging portion 138 may include a recess.

The left faceplate module 150 may further include a microphone housing 140 for accommodating two microphones 142. The microphone housing 140 may be configured to movably engage with the faceplate module housing 114 (the direction of movement as shown by the respective arrows in FIG. 3A and FIG. 3B).

The microphone housing 140 may include a fourth engaging portion 144, the fourth engaging portion 144 configured to engage the third engaging portion 138. The fourth engaging portion 144 may be positioned on at least one side of the microphone housing 140. The fourth engaging portion 144 may be complementary to the third engaging portion 138. The fourth engaging portion 144 may include a protrusion. The fourth engaging portion 144 may include a single wedge shape structure or a plurality of wedge shape structures.

The microphone housing 140 may include two grooves 146 for accommodating the two microphones 142. The microphone housing 140 may further include a fourth opening (not shown) positioned within each of the two grooves 146. Each of the fourth openings may be configured to align with each of the second openings when the left faceplate module 150 may be fitted into the receiving portion.

The left faceplate module 150 may be detachable from the faceplate.

The left faceplate module 150 may include a material selected from the group consisting of a plastic material, a resin material. The left faceplate module 150 may be of the same material as the faceplate. The faceplate module housing 114 may be of the same material as the microphone housing 140.

Figure 4:
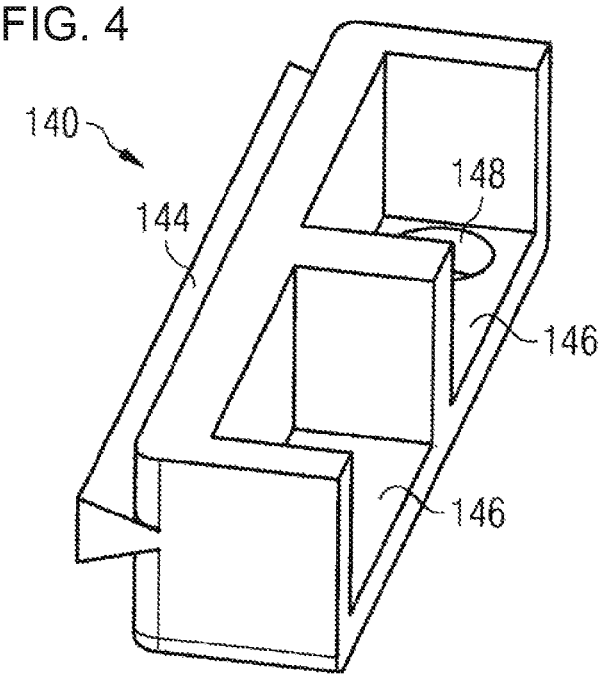
FIG. 4 shows a microphone housing according to an embodiment.

FIG. 4 shows a microphone housing 140 according to an embodiment.

The microphone housing 140 may include a fourth engaging portion 144, the fourth engaging portion 144 configured to engage the third engaging portion (not shown) of the faceplate module housing (not shown). The fourth engaging portion 144 may be positioned on at least one side of the microphone housing 140. The fourth engaging portion 144 may be complementary to the third engaging portion. The fourth engaging portion 144 may include a protrusion. The fourth engaging portion 144 may include a single wedge shape structure which may stretch the length of the microphone housing 140.

The microphone housing 140 may include two grooves 146 for accommodating the two microphones (not shown). The microphone housing 140 may further include a fourth opening 148 positioned within each of the two grooves 146. Each of the fourth openings 148 may be configured to align with each of the second openings (not shown) on the receiving portion (not shown) of the faceplate (not shown) when the faceplate module (not shown) may be fitted into the receiving portion.

The microphone housing 140 may include a material selected from the group consisting of a plastic material, a resin material.

Figure 5:
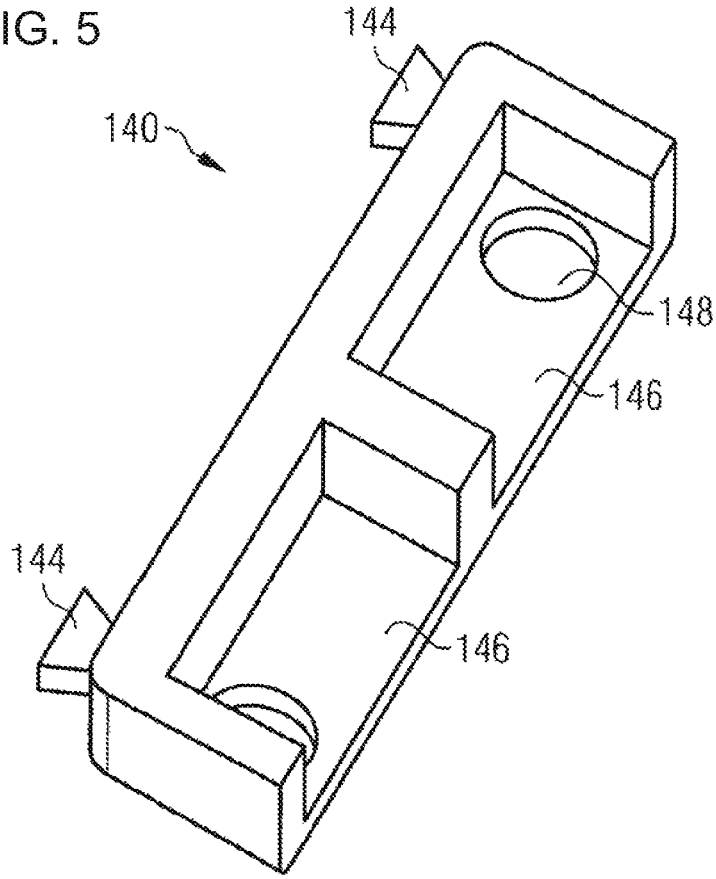
FIG. 5 shows a microphone housing according to an embodiment.

FIG. 5 shows a microphone housing 140 according to an embodiment.

The microphone housing 140 as shown in FIG. 5 may be similar to the microphone housing 140 as shown in FIG. 4 with a difference in the design of the fourth engaging portion 144.

The fourth engaging portion 144 in FIG. 5 may include two separate wedge shape structures, each of which may be smaller in dimension when compared to the single wedge shape structure in FIG. 4. The corresponding description in FIG. 4 applies.

The microphone housing 140 may include a fourth engaging portion 144, the fourth engaging portion 144 configured to engage the third engaging portion (not shown) of the faceplate module housing (not shown). The fourth engaging portion 144 may be positioned on at least one side of the microphone housing 140. The fourth engaging portion 144 may be complementary to the third engaging portion. The fourth engaging portion 144 may include a protrusion. The fourth engaging portion 144 may include two separate wedge shape structures.

The microphone housing 140 may include two grooves 146 for accommodating the two microphones (not shown). The microphone housing 140 may further include a fourth opening 148 positioned within each of the two grooves 146. Each of the fourth openings 148 may be configured to align with each of the second openings (not shown) on the receiving portion (not shown) of the faceplate (not shown) when the faceplate module (not shown) may be fitted into the receiving portion.

The microphone housing 140 may include a material selected from the group consisting of a plastic material, a resin material.

Figure 6A:
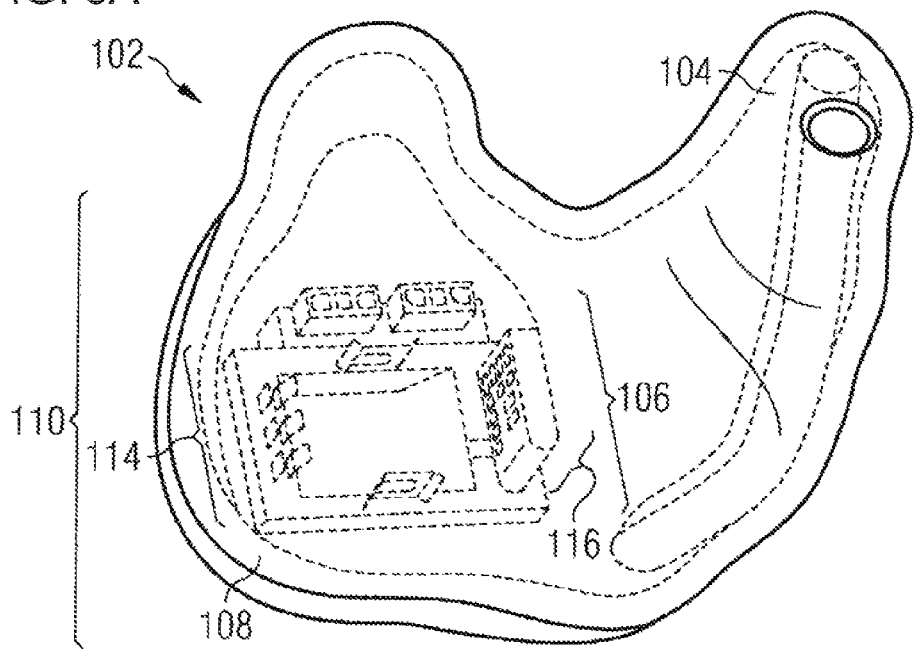
FIG. 6A and FIG. 6B show a respective bottom view and a top view of a hearing aid faceplate arrangement including a hearing aid housing according to an embodiment.
Figure 6B:
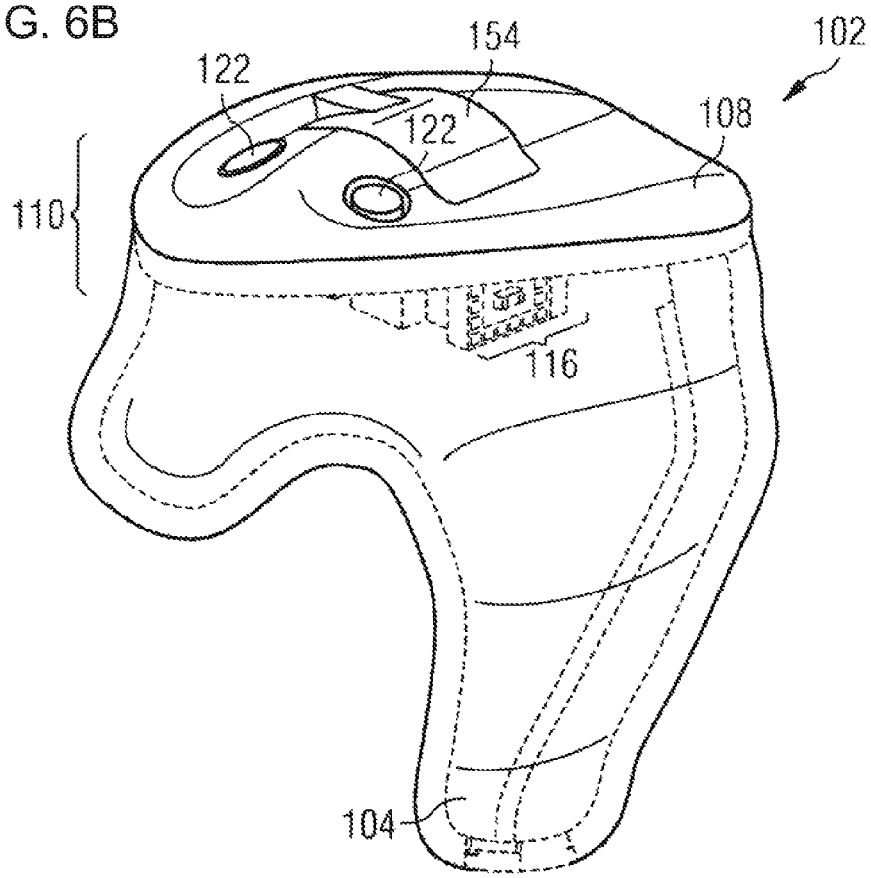

FIG. 6A and FIG. 6B show a respective bottom view and a top view of a hearing aid faceplate arrangement 102 including a hearing aid housing 104 according to an embodiment.

The hearing aid faceplate arrangement 102 may include a hearing aid housing 104 and a faceplate arrangement 110 positioned on the hearing aid housing 104. The faceplate arrangement 110 may include a faceplate 108, the faceplate 108 including a receiving portion (not shown) and a faceplate module 106, the faceplate module 106 including a faceplate module housing 114 having an electronic circuit 116. The faceplate module 106 may be configured to be fitted into the receiving portion (not shown).

The receiving portion may further include a first opening (not shown) for receiving a battery. The first opening may not be shown in FIG. 6 as the first opening may be covered by a battery cover 154.

The receiving portion may further include two second openings 122, each second opening 122 corresponding to each of the two microphones (not shown). Each of the second openings 122 may allow for receiving an acoustic input signal by each of the two microphones and converting it into an electrical signal.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A hearing aid faceplate apparatus, comprising:
a hearing aid housing; and
a faceplate configuration positioned on said hearing aid housing, said faceplate configuration containing:
a faceplate having a receiving portion; and
a faceplate module having a faceplate module housing with an electronic circuit, said faceplate module configured to be fitted into said receiving portion, said faceplate module further having a microphone housing and at least one microphone accommodated in said microphone housing, said microphone housing configured to engage with said faceplate module housing along at least two opposite sides of said faceplate module housing, said faceplate module housing supporting said microphone housing along one of said sides.

2. The hearing aid faceplate apparatus according to claim 1, wherein said receiving portion contains a first engaging portion.

3. The hearing aid faceplate apparatus according to claim 2, wherein said first engaging portion has at least one recess formed therein.

4. The hearing aid faceplate apparatus according to claim 1, wherein said receiving portion further has a first opening formed therein for receiving a battery.

5. The hearing aid faceplate apparatus according to claim 4, wherein said receiving portion further contains a second opening formed therein, said second opening positioned adjacent to said first opening.

6. The hearing aid faceplate apparatus according to claim 2, wherein said faceplate module housing contains a second engaging portion, said second engaging portion configured to engage with said first engaging portion.

7. The hearing aid faceplate apparatus according to claim 6, wherein said second engaging portion is complementary to said first engaging portion.

8. The hearing aid faceplate apparatus according to claim 6, wherein said second engaging portion has at least one protrusion.

9. The hearing aid faceplate apparatus according to claim 6, wherein said faceplate module housing further has at least one programming contact.

10. The hearing aid faceplate apparatus according to claim 6, wherein said faceplate module housing has a pair of battery contacts.

11. The hearing aid faceplate apparatus according to claim 10, wherein said faceplate module housing has a third opening formed therein and is positioned between said pair of battery contacts.

12. The hearing aid faceplate apparatus according to claim 11, wherein said third opening is configured to align with said first opening when said faceplate module is fitted into said receiving portion.

13. The hearing aid faceplate apparatus according to claim 1, wherein said electronic circuit is selected from a group consisting of an amplifier, a surface mount device, a solder contact and a receiver.

14. The hearing aid faceplate apparatus according to claim 6, wherein said faceplate module housing further has a third engaging portion.

15. The hearing aid faceplate apparatus according to claim 14, wherein said third engaging portion is positioned on at least one side of said faceplate module housing.

16. The hearing aid faceplate apparatus according to claim 14, wherein said third engaging portion has a recess formed therein.

17. The hearing aid faceplate apparatus according to claim 5, wherein said microphone housing has a fourth engaging portion, said fourth engaging portion configured to engage said third engaging portion.

18. The hearing aid faceplate apparatus according to claim 17, wherein said fourth engaging portion is positioned on at least one side of said microphone housing.

19. The hearing aid faceplate apparatus according to claim 17, wherein said fourth engaging portion is complementary to said third engaging portion.

20. The hearing aid faceplate apparatus according to claim 17, wherein said fourth engaging portion has a protrusion.

21. The hearing aid faceplate apparatus according to claim 17, wherein said fourth engaging portion has a single wedge shape structure or a plurality of wedge shape structures.

22. The hearing aid faceplate apparatus according to claim 5, wherein said microphone housing has a groove formed therein for accommodating the at least one microphone.

23. The hearing aid faceplate apparatus according to claim 22, wherein said microphone housing further has a fourth opening formed and positioned within said groove.

24. The hearing aid faceplate apparatus according to claim 23, wherein said fourth opening is configured to align with said second opening when said faceplate module is fitted into said receiving portion.

25. The hearing aid faceplate apparatus according to claim 1, wherein said faceplate module is detachable from said faceplate.

26. The hearing aid faceplate apparatus according to claim 1, wherein said faceplate is formed from a material selected from the group consisting of a plastic material and a resin material.

27. The hearing aid faceplate apparatus according to claim 1, wherein said faceplate module includes a material selected from the group consisting of a plastic material and a resin material.

28. The hearing aid faceplate apparatus according to claim 1, wherein said faceplate module is of a same material as said faceplate.

29. The hearing aid faceplate apparatus according to claim 5, wherein said faceplate module housing is of a same material as said microphone housing.

30. A heading aid faceplate apparatus, comprising:

a hearing aid housing;

a faceplate having a receiving portion disposed on said hearing aid housing; and a faceplate module having a faceplate module housing with an electronic circuit, said faceplate module configured to be fitted into said receiving portion, said faceplate module further having a microphone housing and at least one microphone accommodated in said microphone housing, said microphone housing configured to movably engage with said faceplate module housing along all sides of said faceplate module housing, said faceplate module housing supporting said microphone housing along one of said sides.

* * * * *